US007398047B2

(12) United States Patent
Krucinski et al.

(10) Patent No.: US 7,398,047 B2
(45) Date of Patent: Jul. 8, 2008

(54) IMAGE TRACKING CONTROL ALGORITHM

(75) Inventors: Martin Krucinski, Webster, NY (US); Joannes N. M. DeJong, Hopewell Jct, NY (US); Lloyd A. Williams, Mahopac, NY (US)

(73) Assignee: Xerox Corporation, Norwalk, CT (US)

( * ) Notice: Subject to any disclaimer, the term of this patent is extended or adjusted under 35 U.S.C. 154(b) by 353 days.

(21) Appl. No.: 11/157,866

(22) Filed: Jun. 22, 2005

(65) Prior Publication Data

US 2006/0291932 A1 Dec. 28, 2006

(51) Int. Cl.
*G03G 15/00* (2006.01)

(52) U.S. Cl. ..... 399/394; 399/309; 399/396; 271/271; 271/258.01

(58) Field of Classification Search ..... 399/394, 399/396, 301; 271/270, 258.01
See application file for complete search history.

(56) References Cited

U.S. PATENT DOCUMENTS

| | | | | |
|---|---|---|---|---|
| 4,733,269 | A * | 3/1988 | Kasahara et al. | 399/301 |
| 5,884,118 | A | 3/1999 | Mestha et al. | |
| 6,301,451 | B1 * | 10/2001 | Ando et al. | 399/38 |
| 6,322,069 | B1 | 11/2001 | Krucinski et al. | |
| 6,533,268 | B2 | 3/2003 | Williams et al. | |
| 6,550,762 | B2 | 4/2003 | Stoll | |
| 6,736,561 | B2 | 5/2004 | Castelli et al. | |
| 6,746,113 | B1 | 6/2004 | Leighton et al. | |
| 6,763,199 | B2 | 7/2004 | Conrow et al. | |

* cited by examiner

*Primary Examiner*—Ren Yan
*Assistant Examiner*—Andy L Pham
(74) *Attorney, Agent, or Firm*—Pillsbury Winthrop Shaw Pittman LLP

(57) ABSTRACT

An image-to-sheet closed loop registration system tracking the image drum position and/or velocity and coordinating movement of the sheet into the transfer nip based on such information.

9 Claims, 5 Drawing Sheets

IMAGE TRACKING CONTROL ALGORITHM

BACKGROUND

All references cited in this specification, and their references, are incorporated by reference herein where appropriate for teachings of additional or alternative details, features, and/or technical background.

Disclosed in the embodiments herein is an image-to-sheet closed loop registration system tracking the image drum position and/or velocity and coordinating movement of the sheet into the image transfer nip based on such image drum position and/or velocity data.

The goal of a paper path system in a typical xerographic printing system is to transport media from a feeding unit in synchronism with a moving image bearing photoreceptor surface. The movement of the media to a transfer zone necessarily must arrive at the transfer zone at a given time and with a given velocity to match the velocity of the image bearing photoreceptor surface. Image forming systems involve a variety of internal components configured to manipulate a piece of paper and produce an image on the paper.

Prior art systems may comprise open loop systems with the media running at a specific speed, and position adjustment being made at a transfer registration station just prior to transfer. A difficulty with such systems is the often erratic and abrupt adjustments that must be made at the registration station due to the unpredictability of photoreceptor and media drives and the uncertainty of the position of the image on the photoreceptor. With little time and space for adjustment, the correction can be erratic. This is particularly true in higher speed, higher volume machines.

For this reason, some image forming apparatuses incorporate into the paper transporting system a mechanism for adjusting the timing of the paper reaching the image transfer position. For example, there is a construction in which, as shown in FIG. 5, two paper transporting rollers A, B are arranged along the paper transporting direction of the paper P. In this construction, the paper P fed by the paper transporting roller B on the upstream side is struck against the paper transporting roller A on the downstream side which is at rest and then the timing at which to start rotating the paper transporting roller A is adjusted to match the timing at which the paper arrives at the transfer position to the toner image arrival timing.

In order to correct for a difference in the transfer position arrival timing between the paper and the toner image. A so-called nonstop servo-registration control may be adopted which temporarily stops the paper in front of the paper transporting roller A and rotates the paper transporting roller A as the lead edge of the paper reaches the paper transporting roller A. This may eliminate possible variations in the paper engagement condition and thereby improve the precision of the paper position relative to the paper transporting roller A.

While such correction process may improve the precision of the timing of the paper arriving at the transfer position, variations in the toner image arrival timing may become a serious problem. That is, when variations in the toner image arrival timing occur, for example, due to changes in velocity of the print drum with elapse of time, it becomes difficult to match the paper arrival timing with the toner image arrival timing, even with an improved precision of the timing of the paper arriving at the transfer position. Especially in an image forming apparatus that uses an image carrying belt, such as a photosensitive belt and an intermediate transfer belt, variations in the toner image arrival timing may occur because the image carrying belt elongates or contracts in response to changes in temperature, humidity or belt tension.

FIG. 1 illustrates an image producing machine in which synchronization of the transport media from a feeding unit to the moving image on the photoreceptor surface is particularly difficult given its high speed and volume. A high-speed phase change ink image producing machine or printer 10 is illustrated. As illustrated, the machine 10 includes a frame 11 to which are mounted directly or indirectly all its operating subsystems and components. To start, the high-speed phase change ink image producing machine or printer 10 includes an imaging member 12 that is shown in the form of a drum, but can equally be in the form of a supported endless belt. The imaging member 12 has an imaging surface 14 that is movable in the direction 16, and on which phase change ink images are formed.

The high-speed phase change ink image producing machine or printer 10 also includes a phase change ink system 20 that has at least one source 22 of one color phase change ink in solid form. Since the phase change ink image producing machine or printer 10 is a multicolor image producing machine, the ink system 20 includes for example four (4) sources 22, 24, 26, 28, representing four (4) different colors CYMK (cyan, yellow, magenta, black) of phase change inks. The phase change ink system 20 also includes a phase change ink melting and control assembly 100 (FIG. 2), for melting or phase changing the solid form of the phase change ink into a liquid form. Thereafter, the phase change ink melting and control assembly 100 then controls and supplies the molten liquid form of the ink towards a printhead system 30 including at least one printhead assembly 32. Since the phase change ink image producing machine or printer 10 is a high-speed, or high throughput, multicolor image producing machine, the printhead system includes for example four (4) separate printhead assemblies 32, 34, 36 and 38 as shown.

As further shown, the phase change ink image producing machine or printer 10 includes a substrate supply and handling system 40. The substrate supply and handling system 40 for example may include substrate supply sources 42, 44, 46, 48, of which supply source 48 for example is a high capacity paper supply or feeder for storing and supplying image receiving substrates in the form of cut sheets for example. The substrate supply and handling system 40 in any case includes a substrate handling and treatment system 50 that has a substrate pre-heater 52, substrate and image heater 54, and a fusing device 60. The phase change ink image producing machine or printer 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem 80. The electronic subsystem or controller 80 for example is a self-contained, dedicated mini-computer having a central processor unit 82, electronic storage 84, and a display or user interface 86. The electronic subsystem or controller 80 for example includes sensor input and control means 88 as well as a pixel placement and control means 89. In addition the central processing unit 82 reads, captures, prepares and manages the image data flow between image input sources such as the scanning system 76, or an online or a work station connection 90, and the printhead assemblies 32, 34, 36, 38. As such, the electronic subsystem or controller 80 is the main multi-tasking processor for operating and controlling all of the other machine subsystems and functions, including the machine's printing operations.

In operation, image data for an image to be produced is sent to the controller 80 from either the scanning system 76 or via the online or work station connection 90 for processing and output to the printhead assemblies 32, 34, 36, 38. Additionally, the controller determines and/or accepts related subsystem and component controls, for example from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by anyone of the sources 42, 44, 46, 48 and handled by means 50 in timed registration with image formation on the surface 14. Finally, the image is transferred within the transfer nip 92, from the surface 14 onto the receiving substrate for subsequent fusing at fusing device 60.

REFERENCES

U.S. Pat. No. 5,884,118, commonly assigned, discloses a system wherein the image on the first copy sheet is scanned and provides the image on a second copy sheet. The image on the second copy sheet is sensed and compared to a reference image to calibrate the imaging machine. The calibration sequence is automatically initiated via control data stored in a memory.

U.S. Pat. No. 6,301,451, commonly assigned, discloses an image forming apparatus that has an image forming unit to make an image-on-image carrier, a transfer unit to transfer the image on the image carrier onto the paper, a transporting unit to transport the paper toward the transfer unit, a calculation unit to calculate a time when the image on the image carriers will arrive at the image transfer position or nearby position, and to correct the calculated result according to a predetermined parameter, and a control unit to control the paper transporting operation of the transporting unit according to the time determined by the calculation unit.

U.S. Pat. No. 6,322,069, commonly assigned, discloses a method of synchronizing the arrival of copy sheets at a photoreceptor in an image processing having a copy sheet path having a plurality of segments coupled at given transfer zones, a plurality of copy sheet drives, an image transfer station, a photoreceptor and a controller. The controller directs the image processing apparatus by tracking the movement of copy sheets at the image transfer station in relation to the movement of the photoreceptor, monitoring the movement of copy sheets at the transfer zones, determining the need to adjust the spacing of copy sheets along the plurality of segments of the copy sheet path, and suitably activating selected copy sheet drives.

U.S. Pat. No. 6,550,762, commonly assigned, discloses a high speed reproduction apparatus in which closely spaced printed sheets are sequentially fed downstream in a sheet path at a process velocity.

U.S. Pat. No. 6,746,113, commonly assigned, discloses a solid phase change ink image producing machine.

U.S. Pat. No. 6,763,199, commonly assigned, discloses a system wherein initial setup of image-to-sheet or image-to-paper registration in a printing device such as, for example, an electrographic printer, is accomplished in a single step that uses an initial set of measurements to determine and correct each of the independent registration errors, including image squareness/ROS skew, image skew/paper skew, lateral magnification, process magnification, lateral direction image-to-sheet or image-to-paper position, and process direction image-to-sheet or image-to-paper position simultaneously. A set of algorithms is used to perform a series of geometrical transformations to determine each of the six errors affecting image-to-sheet or image-to-paper registration.

U.S. Pat. No. 6,736,561, commonly assigned, discloses a system which provides a capability to form an image along a trailing edge of the paper by the use of a trailing edge deletion prevention apparatus capable of manipulating the paper to allow components capable of forming the image to travel in proximity to the paper without obstruction. In various embodiments, the invention involves the use of a biasing member or an interdigitated support element, each providing a trailing edge deletion prevention capability.

SUMMARY

Aspects disclosed herein include:

a system comprising an image carrying member operationally configured to receive and transfer an image at an image transfer point of the image carrying member to a sheet material; a sheet registration system operationally configured to be capable of varying the arrival time of the sheet material at the image transfer point on the image carrying member; one or more sensors for detecting, with respect to time, motion parameters of the image carrying member; a processor receiving input from one or more sensors and in communication with the sheet registration system and responsive to an instruction set for determining the position and/or velocity of the image carrying member from motion parameter input from one or more sensors and controlling the sheet registration system so as to lead to image-to-paper registration, taking into account the sensor input;

an image-to-sheet registration system comprising an image carrying member operationally configured to receive and transfer, at an image transfer point on the image carrying member, an image to a sheet material; a sheet registration system operationally configured to vary the arrival time of the sheet material at an image transfer point; one or more sensor devices for detecting, with respect to time, the motion parameters of the image on the image carrying member; and a processor receiving input from one or more sensor devices and configured to coordinate image-to-paper registration, taking into account the motion parameters detected by one or more sensor devices; and a method for controlling image-to-sheet registration in a printing device employing a transfix roller operationally associated with an image transfer drum and configured to permit printing medium to move through a nip from therebetween, and including a sheet registration system for supplying sheet material to the nip, the method comprising measuring motion parameters associated with the image transfer drum; and adjusting sheet supply into the nip of the sheet registration system based on the motion parameters to cause registration of the image to the sheet within predetermined areas on the sheet.

BRIEF DESCRIPTION OF THE DRAWINGS

Various of the above mentioned and further features and advantages will be better understood from this description of embodiments thereof, including the attached drawing figures wherein.

DETAILED DESCRIPTION

In embodiments, there is illustrated a method for image-to-paper registration by an algorithm that actively measures and tracks the motion profile of an image, permitting the sheet and image to be delivered at an appointed time, position and velocity for accurate registration. The measurement of the image motion is used to cause the registration device controller to adjust the sheet motion profile, taking into account the target image position and velocity.

To achieve accurate image-to-paper registration in the process direction, at least two requirements generally need to be fulfilled—the image has to arrive at the transfer nip at the desired time and the desired velocity, and the paper has to arrive at the transfer nip at the desired time and the desired velocity. The imaging drum carries the image to the transfer nip while the registration device drives the paper to the transfer nip.

The four edges of a sheet can be described relative to the direction that the sheet moves through a printing apparatus. The outboard edge and the inboard edge are the edges that define the process length. The outboard edge can refer to the edge of the sheet closest to the registration surface of the printing apparatus, and the inboard edge can refer to the opposite edge (i.e., the edge farthest from a registration surface, or vice versa). The leading edge and the trailing edge are the edges that define the lateral width of the sheet. The leading edge is the forward edge as the sheet moves through a printing apparatus, and the trailing edge is the opposite edge.

Figure 4:
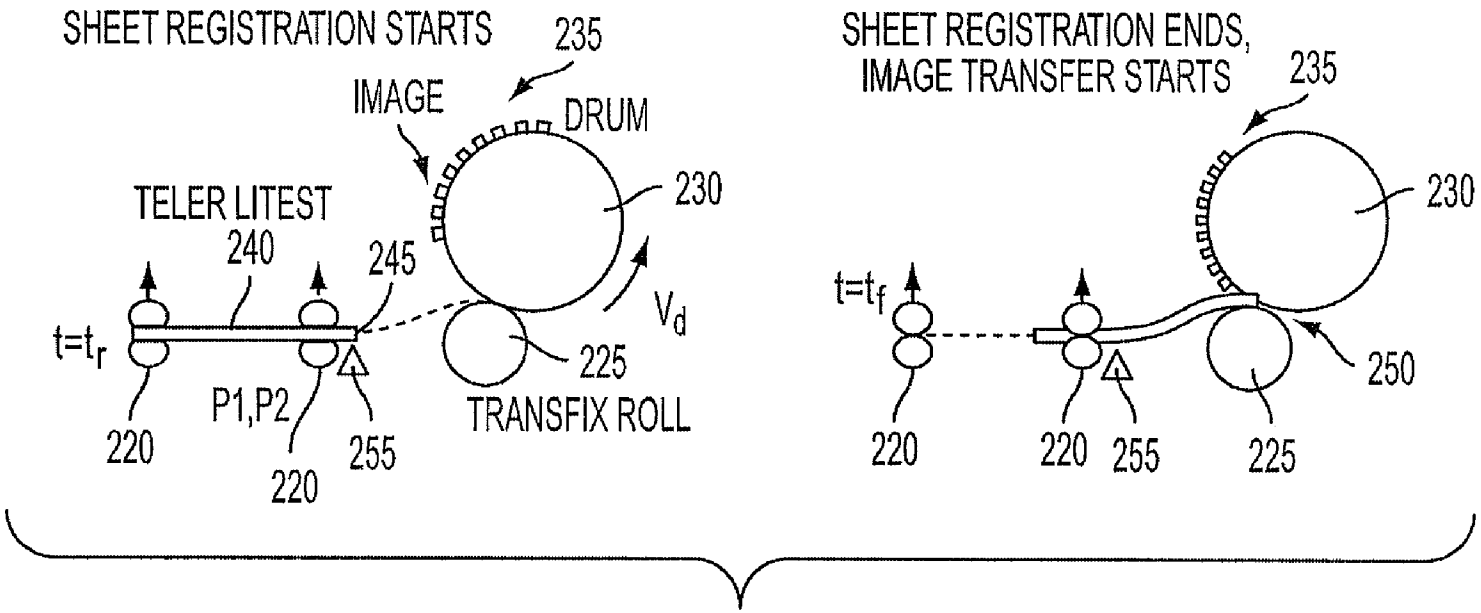
FIG. 4 (PRIOR ART)
FIG. 4 is a general schematic of an image drum-transfix roller printing system wherein image transfer occurs in the image drum-transfix roller nip.
Figure 5:
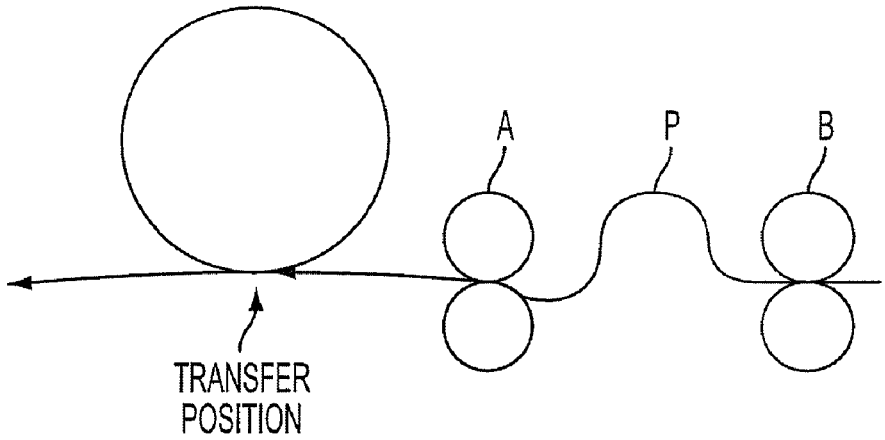
FIG. 5 (PRIOR ART)
FIG. 5 is a schematic diagram of a conventional paper forwarding system.

Now turning to FIG. 4, there is shown a prior art open loop paper-image registration system in a transfix roll-image drum printer. Registration starts when the leading edge of the paper sheet 240 covers registration sensor(s) 255. The registration controller at this point calculates a move time from the rollers 220, 220' based on a preset time for the leading edge 245 of paper sheet 240 to arrive at the transfer nip 250 given the current time and the initial and final velocities. The leading edge 245 of paper sheet 240 is then moved into transfer nip 250. Such algorithmic control accounts for any image position error e(t) accrued to the point but does not account for any image error from the time the leading edge 245 is detected by sensor(s) 255 until the image is actually transferred to paper sheet 240. That is, the paper registration is performed open loop with respect to the image position after the registration move starts until the start of image transfer.

In printing devices (by which it is meant to include copying and offset devices) employing a print feed comprising a transfix roller and an image drum between which the print medium is run conjunctively (the interface of the drum roller and transfix roller being referred to as the "transfer nip"), there is often an engage/disengage protocol followed such that the transfix roller engages the image drum when print medium is positioned to be fed beneath the image drum, but disengages when the print medium receives the image on the image drum and is fed onward through the process. The continual engagement/disengagement may lead to friction variations (e.g., drum brake friction variations, drum motor and gear once-around friction variations, drum once-around friction variations) and run-out errors to give disturbances and drum maintenance problems that may cause the image to arrive at the image transfer nip at a different time than intended. That is, drum motion variations due to the transfix roller engage/disengage cycles may affect the registration accuracy of each individual sheet.

The position of an image-on-image drum may be defined by the equation $x(t)=\int v(t)dt=R\ \theta(t)$ where R is the drum diameter and $\theta(t)$ is the accumulated drum rotation angle for the image, which is different than the desired nominal position which is $X_d(t)=\int V_d(t)dt=V_d t+C$ where C is a constant offset position for each sheet. The difference between the image position and its desired position at any given time, the "image position error," is given by $e(t)=x_d(t)-x(t)$. Therefore, for an image position error change between start of sheet registration to start of image transfer from −0.008 m to −0.011 m, there is a 3 mm process direction registration error due to drum movement during the registration interval.

In an embodiment of the invention, a closed loop control system is used to track the image position and/or velocity of the image on the image drum and the leading edge of the printing medium, such as paper, and to control the movement of the leading edge of the paper in the registration nip so as to cause desired registration of the image to the printing medium. Registration performance may be enhanced by tracking both the position and velocity. However, one may implement a drum position only or velocity only feedback controller.

In one embodiment, a closed loop control algorithm for the print medium registration device is provided that tracks the image position on the image drum to right before the delivery of the print medium, such as a print sheet, to the transfer nip and alters parameters of the print medium registration device to allow medium-image registration in respect to printing the image in a desired area of the medium. Such closed loop control algorithm may use, for example, the feedback of drum position and/or drum velocity to control the position and/or velocity of the registration nip to cancel the effect of drum motion disturbances.

In yet another embodiment, the difference between the image drum nominal velocity and the drum actual velocity, and/or the difference between the image drum nominal position with respect to sensing of the leading edge of the sheet and the image drum actual position at this point, is used to control feed of the sheets into the transfer nip with feedback provided in respect of the actual feed rate into the transfer nip and actual position of the sheet in respect of the image on the drum. Such position and/or velocity feedback allows for enhanced registration of the image-to-sheet transfer at the desired positions on the sheet.

In another embodiment, there is disclosed a system comprising an image carrying member operationally configured to receive and transfer an image at an image transfer point of the image carrying member to a sheet material; a sheet registration system operationally configured to be capable of varying the arrival time of the sheet material at the image transfer point on the image carrying member; one or more sensors for detecting, with respect to time, motion parameters of the image carrying member; a processor receiving input from one or more sensors and in communication with the sheet registration system and responsive to an instruction set for determining the position and/or velocity of the image carrying member from motion parameter input from one or more sensors and controlling the sheet registration system so as to lead to image-to-paper registration, and taking into account the sensor input.

The image carrying member may be an image transfer drum. The image transfer drum may be operationally associated with a transfix roller, with the image transfer to the sheet material occurring between the transfix roller and the image transfer drum. The position of the actual image on the image transfer drum to the sheet between the transfix roller and image transfer drum may be measured. The one or more sensors may comprise, for example, an encoder, and the processor may be, for example, a microchip-based processor. The system may also comprise one or more sensors positioned along the path running from (and including) the sheet registration system to the image carrying member. The sheet registration system may comprise one or more paired roller sets between which the sheet material courses. The system may include sensors that allow for measurement of both the position and velocity of the image carrying member.

Figure 1:
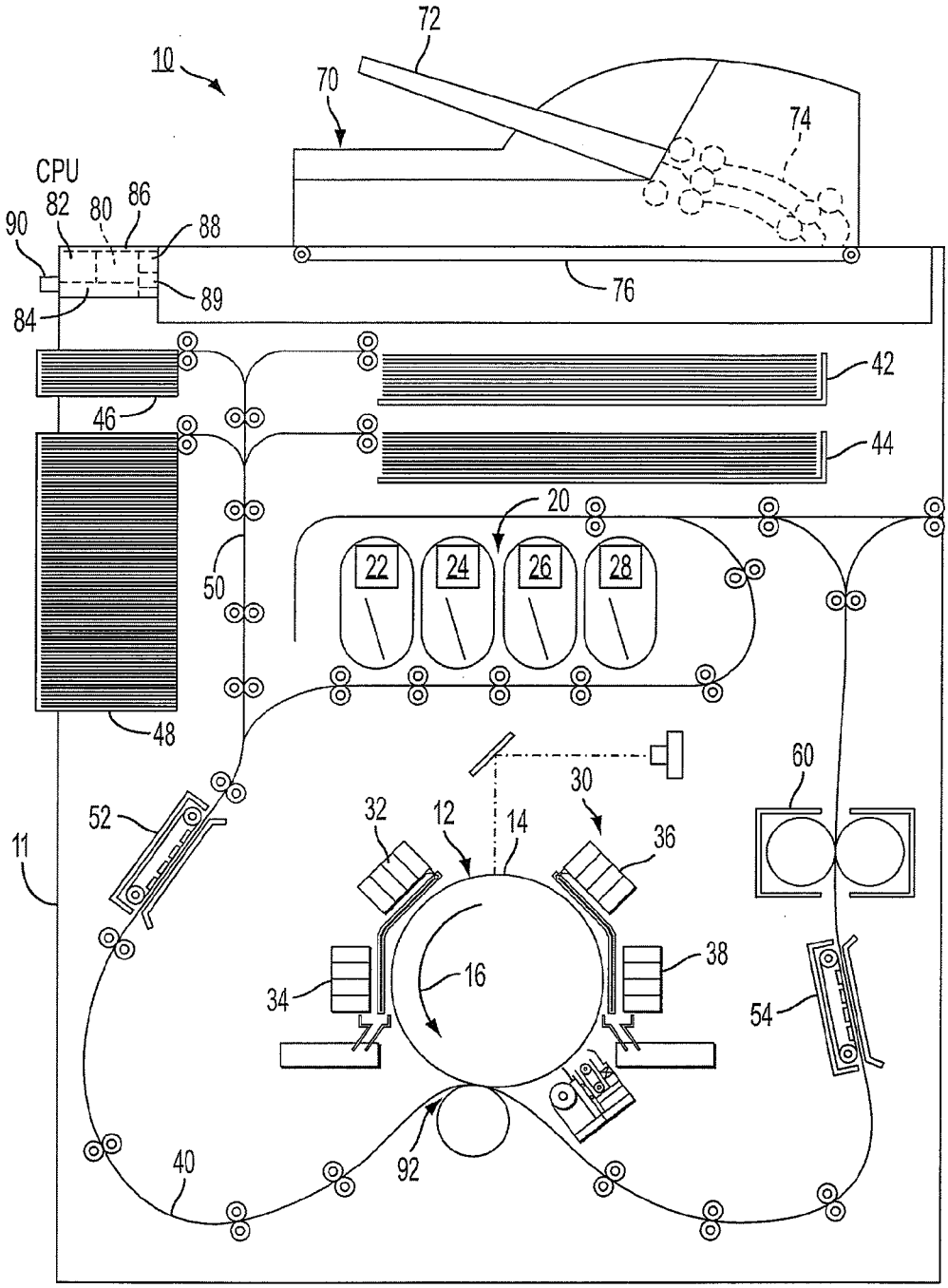
FIG. 1 (PRIOR ART)
FIG. 1 shows a prior art vertical schematic of a high-speed phase change ink image producing machine or printer including a solid phase change ink pre-melter assembly.
Figure 2:
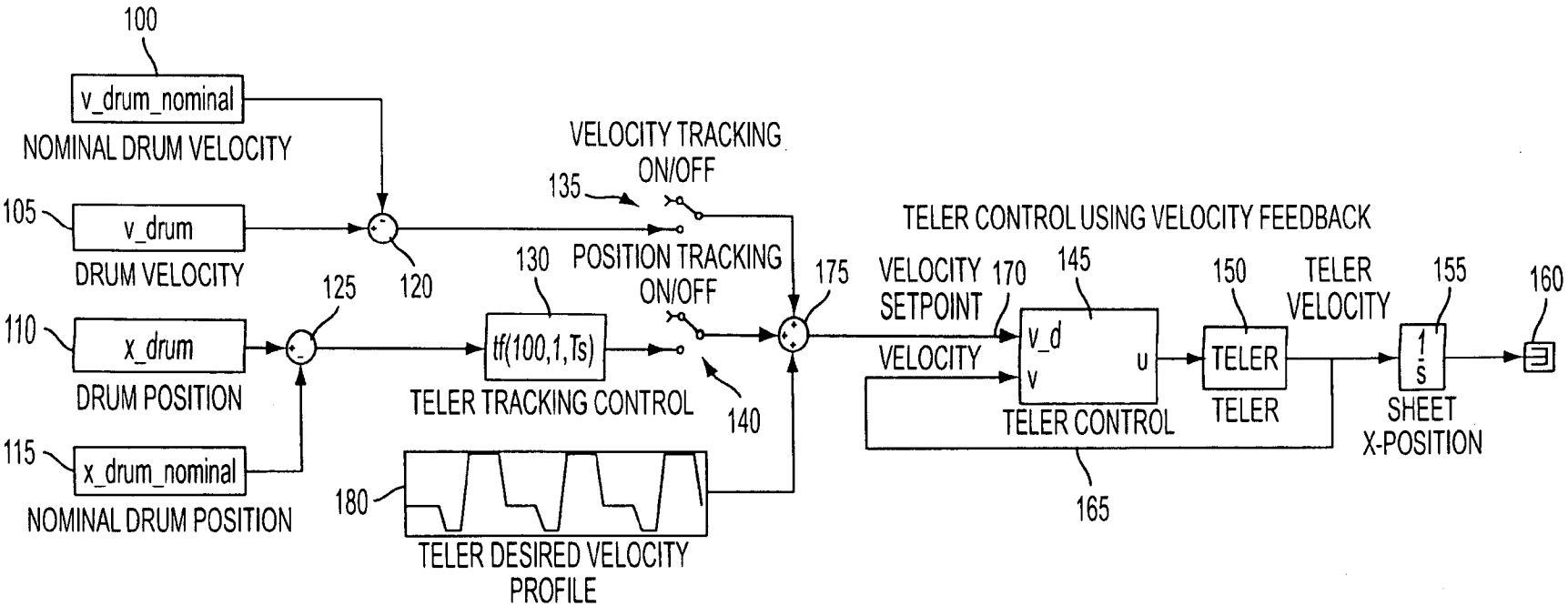
FIG. 2 is a block diagram of a velocity tracking control algorithm using velocity feedback which finds use in an embodiment of the present disclosure.

Now turning to FIG. 2, there is shown a block diagram of a velocity tracking control algorithm finding use in an embodiment of the present disclosure. Such algorithm makes use of measurements of the velocity 105 and position 110 of the image drum as compared to predetermined nominal drum velocity 100 and nominal drum position 115. Comparison of the measured velocity 105 of the drum to the nominal drum velocity 100 is made at calculation point 120, and actual drum position 110 is compared to nominal drum position 115 at calculation point 125. The difference between the nominal drum position 115 and the actual drum position 110 is used in registration tracking control algorithm 130 to provide position correction information at calculation point 175 when position tracking 140 is on. In conjunction with such position correction information, drum velocity information, when velocity tracking 135 is on, and registration system desired velocity profile 180 are used at calculation point 175 to set a velocity setpoint 170 for the registration system and to provide the same to registration controller 145. Registration controller 145 provides input into registration unit 150 to control the velocity of movement of the sheet through registration unit 150. Actual registration velocity feedback 165 is provided to registration controller 145 to further refine the control signal sent to registration unit 150 in respect of desired registration velocity, all to improve the sheet position 155 in respect of the image-on-image drum 160).

Figure 3:
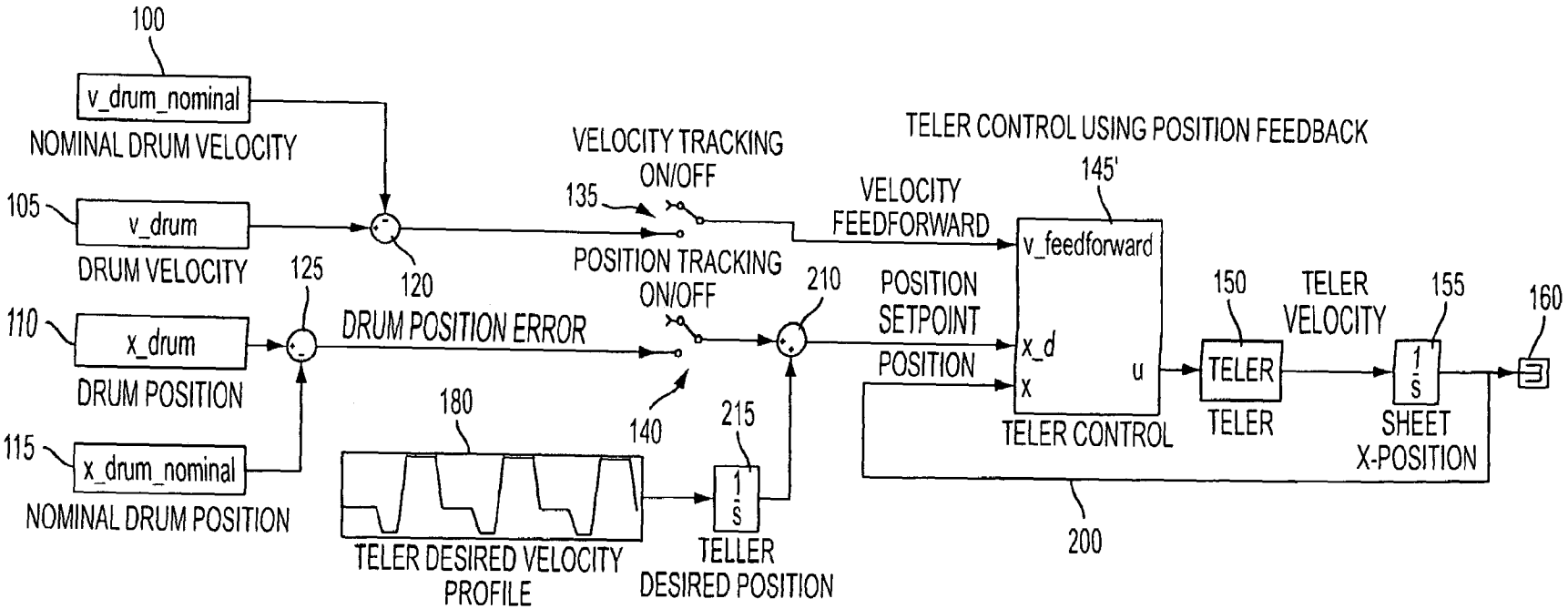
FIG. 3 is a block diagram of a velocity tracking control algorithm using position feedback which finds use in an embodiment of the present disclosure.

Now turning to FIG. 3, there is shown a block diagram of a velocity tracking control algorithm finding use in an embodiment of the present disclosure. Such algorithm makes use of measurements of the velocity 105 and position 110 of the image drum as compared to predetermined nominal drum velocity 100 and nominal drum position 115. Comparison of the measured velocity 105 of the drum to the nominal drum velocity 100 is made at calculation point 120, and actual drum position 110 is compared to nominal drum position 115 at calculation point 125. When velocity tracking 135 and position tracking 140 are "on," and the registration system desired velocity profile 180 and registration desired position 215 are known, a position setpoint is determined at calculation point 210. Registration controller 145' receives input regarding velocity feedforward and position setpoint and provides input into registration unit 150 to control the velocity of movement of the sheet to registration unit 150. Position feedback 200 is provided with respect to sheet position 155 in regard to the image-on-image drum 160, to registration controller 145' to improve sheet position 155 in regard to the image-on-image drum 160 (i.e., to improve registration of the image print to the area which is desired to be imprinted on the sheet.

While the invention has been particularly shown and described with reference to particular embodiments, it will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A system comprising:

an image carrying member operationally configured to receive and transfer an image at an image transfer point of said image carrying member to a sheet material;

a sheet registration system operationally configured to be capable of varying the arrival time of said sheet material at said image transfer point on said image carrying member;

one or more sensors for detecting, with respect to time, a position and/or velocity of said image carrying member; and a processor arranged to receive the detected position and/or velocity from the one or more sensors and to communicate with said sheet registration system, the processor configured to:

determine correction information based on a difference between the detected position and a nominal position of the image carrying member and/or a difference between the detected velocity and a nominal velocity of the image carrying member, forward the correction information to the sheet registration system to control the velocity of movement of the sheet material, and receive feedback information from the sheet registration system regarding actual velocity of the sheet material to refine the forwarded correction information and provide a more accurate transfer of the image at the image transfer point of the image carrying member.

2. The system of claim 1 wherein said image carrying member is an image transfer drum.

3. The system of claim 2 wherein said image transfer drum is operationally associated with a transfix roller.

4. The system of claim 3 wherein said image transfer to said sheet material occurs between said transfix roller and said image transfer drum.

5. The system of claim 1 wherein said one or more sensors comprises an encoder.

6. The system of claim 1 wherein said processor is a microchip-based processor.

7. The system of claim 1 wherein said system further comprises one or more sensors positioned along the path comprising the sheet registration system to said image carrying member.

8. The system of claim 1 wherein said sheet registration system comprises one or more paired roller sets between which said sheet material is fed.

9. A method for controlling image-to-sheet registration in a printing device employing a transfix roller operationally associated with an image transfer drum and a sheet registration system for supplying sheet material, said method comprising:

detecting a position and/or velocity of the image transfer drum;

determining correction information based on a difference between the detected position and a nominal position of the image transfer drum and/or a difference between the detected velocity and a nominal velocity of the image transfer drum;

forwarding the correction information to the sheet registration system to control the velocity of movement of the sheet material, and receiving feedback information from the sheet registration system regarding actual velocity of the sheet material to refine the forwarded correction information and provide a more accurate transfer of the image at an image transfer point of the image transfer drum.

* * * * *